US005799445A

United States Patent [19]

Kock

[11] Patent Number: 5,799,445

[45] Date of Patent: Sep. 1, 1998

[54] ROOF GUTTER OVERFLOW PROTECTION METHOD AND APPARATUS

[76] Inventor: Ronald W. Kock, 577 Abilene Trail, Wyoming, Ohio 45215

[21] Appl. No.: 858,676

[22] Filed: May 19, 1997

[51] Int. Cl.[6] ..... E04D 13/08

[52] U.S. Cl. ..... 52/16; 52/11

[58] Field of Search ..... 52/11, 16, 95, 52/12, 15

[56] References Cited

U.S. PATENT DOCUMENTS

| | | | |
|---|---|---|---|
| 3,967,452 | 7/1976 | Maloney, Jr. | 61/15 |
| 3,990,474 | 11/1976 | Harms | 137/611 |
| 4,253,281 | 3/1981 | Ruttenberg | 52/12 |
| 4,602,460 | 7/1986 | Langenbach | 52/1 |
| 4,709,516 | 12/1987 | Gleaves | 52/11 |
| 4,956,948 | 9/1990 | Hart | 52/16 |
| 4,998,386 | 3/1991 | Baumgarth | 52/16 |
| 5,457,916 | 10/1995 | Tenute | 52/12 |

*Primary Examiner*—Creighton Smith
*Attorney, Agent, or Firm*—Ronald W. Kock

[57] ABSTRACT

A method and apparatus for providing rainwater overflow protection for a roof gutter. The method includes removing rainwater under the force of gravity from the gutter via a conduit connected at an opening in a substantially vertical wall at one end of the gutter. A further step includes directing the rainwater from the opening through a downward turning transition section in the conduit such that a substantially horizontal rainwater flow direction is gradually converted to a downward flow direction. A portion of the rainwater may be further directed via the conduit from the gutter to a conventional downspout connected to a bottom surface of the gutter. In this alternative, the conduit joins the conventional downspout at a location at least six inches below the bottom surface of the gutter and serves as a bypass for a plugged conventional downspout opening.

12 Claims, 1 Drawing Sheet

ROOF GUTTER OVERFLOW PROTECTION METHOD AND APPARATUS

FIELD OF THE INVENTION

The present invention relates to roof-edge rain gutters which frequently have downspout openings clogged with leaves or other debris, and more particularly to a method and apparatus for protecting against a clogged gutter overflowing with water in a rainstorm.

BACKGROUND OF THE INVENTION

Roof gutters are typically designed as long troughs having a closed bottom, closed sides, an open top, and two closed ends. The gutter is normally installed such that a bottom surface has a slope of about one inch in 20 feet. This enables rainwater flowing from the roof and into the gutter to flow by gravity to one end of the gutter where a downspout is located. A gutter downspout is typically a closed conduit which has fluid communication with the gutter at an opening in the bottom of the gutter.

Due to the gentle slope of the bottom of the gutter, rainwater slowly flows to the downspout opening, and then drops through the opening into the downspout. The downspout opening is typically smaller in cross-sectional area than the cross-sectional area of the gutter. The opening is therefore a bottleneck to water flow. To enter the downspout opening, water flowing along the length of the gutter must make a right angle turn instantaneously. As a result, leaves, twigs, pollen, and tree flowers, which tend to float on the surface of the rainwater, don't always make the turn cleanly. The debris initially becomes stuck at the edges of the opening, particularly if the edges of the opening are rough. The flow of rainwater must then pass over and through the stuck debris to flow into the downspout. As the rainwater flow rate is reduced by initial debris, successive debris accumulates and gradually clogs the opening completely. The gutter then eventually fills with rainwater and overflows.

When a roof gutter is located adjacent to tree branches, debris falls into the gutter from trees even when it is not raining. When a rainstorm begins, the accumulation of debris already in the gutter is suddenly washed to the downspout opening. Clogging occurs at the very early stages of a rainstorm in this situation.

Overflowing gutters behave as if there were no gutters at all. Overflow allows rainwater to fall in sheets from the gutter to pound the ground below, causing erosion and wet or leaking foundations.

The prior art discloses gutter screens, roof water diverters, etc. These are typically expensive because they require installation along the entire length of the gutter. The prior art also discloses mechanisms and fluid sprayers to unclog downspout openings. None of these latter devices have proven to be acceptable solutions in the marketplace. Gutter screens often make the problem worse because pollen, shingle grit, etc., can pass through such screens and accumulate in the gutter. Fixed screens make gutter cleaning more difficult.

Because downspout clogging usually occurs at the beginning of a rainstorm, clogging isn't evident until after a rainstorm begins. Once the rainstorm is in progress, few people have the desire to venture onto a roof to unclog the downspout during a storm. Most homeowners still clean their open gutters by hand, once a rainstorm has caused overflowing, foolishly hoping to prevent the next overflow occurance. What is needed is either a downspout design which avoids clogging or a bypass conduit to prevent rainwater overflow until the downspout opening can be unclogged.

SUMMARY OF THE INVENTION

The problem with conventional downspout design is that it fails to take advantage of rainwater flow inertia. Because rainwater flows substantially horizontally toward the end of the gutter, the downspout opening should be located in a vertical plane at the end of the gutter instead of at the bottom of the gutter. This arrangement eliminates the instantaneous right angle turn into the downspout and permits a more gradual turn downward after the debris and rainwater have already passed from the open gutter into a closed conduit. It also enables floating debris to enter the conduit opening near the top of the opening. Floating debris may even be lifted out of the rainwater flowpath and over the end of the gutter, thereby self-clearing the conduit opening.

It is therefore an object of the present invention to provide a downspout apparatus which effectively avoids clogging at its opening to the gutter.

It is another object of the present invention to provide a gutter overflow protection apparatus at an end of a gutter, which enables rainwater to bypass a plugged opening of a conventional downspout located at a bottom surface of a gutter and instead flow out a conduit at the end of the gutter, through a gradual turn, and into the downspout at a level below the gutter.

It is still another object of the present invention to provide a method for draining a gutter such that rainwater overflow is minimized.

In one aspect of the present invention, a method for providing rainwater overflow protection for a roof gutter comprises the step of removing rainwater from the gutter via a conduit connected to the gutter at a substantially vertical wall of the gutter. The substantially vertical wall has an opening therein providing fluid communication between the gutter and the conduit. A further step includes directing the rainwater from the opening in the gutter through the conduit such that a substantially horizontal rainwater flow direction is gradually converted to a downward flow direction within the conduit.

The substantially vertical wall may be located at a lower end of the gutter. The conduit may have an inside turning radius of at least one inch and a cross-sectional area at its gutter opening of at least four square inches. The opening may be located as close as possible to a bottom surface of the gutter.

A portion of the rainwater may be further directed via the conduit from the gutter to a conventional downspout. The downspout has fluid communication with a bottom surface of the gutter at an opening therein. In this alternative embodiment, the conduit may join the conventional downspout at a location at least six inches below the bottom surface and in fluid communication with the conventional downspout. The conduit thereby serves as a bypass for a conventional downspout opening when the downspout opening becomes clogged with debris. When the conduit serves as a bypass, it is preferable to locate the conduit opening in the vertical wall less than an inch below a top edge of the gutter.

In another aspect of the present invention, a roof rainwater overflow protection apparatus comprises a conduit connected to the gutter at a substantially vertical wall of the gutter. The substantially vertical wall has an opening therein providing fluid communication between the gutter and the conduit. The apparatus also comprises a transition section in the conduit to gradually convert a substantially horizontal rainwater flow direction to a downward flow direction.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
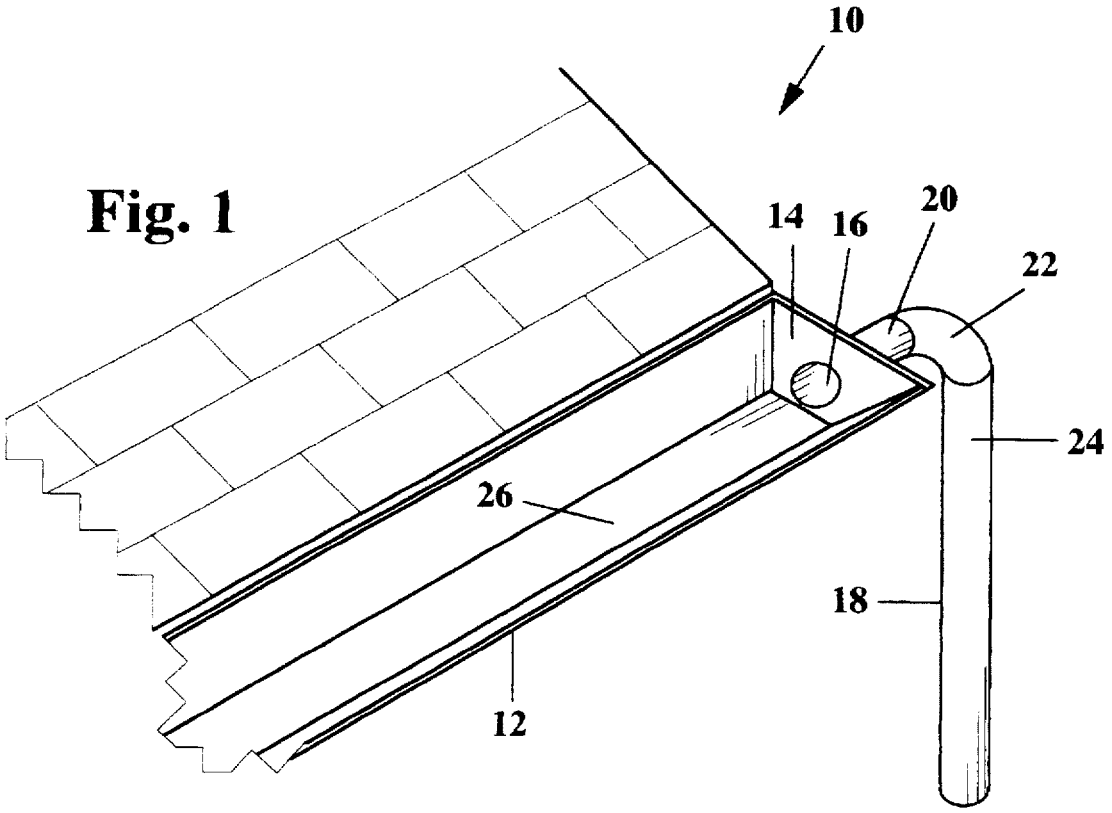
FIG. 1 is a perspective view of a preferred embodiment of the gutter overflow protection apparatus of the present invention, disclosing a conduit connected to a vertical wall at the end of a gutter.

Referring now to the drawings, and more particularly to FIG. 1, there is shown a first preferred embodiment of the present invention, which is generally indicated as 10. Embodiment 10 is an apparatus which provides overflow protection to a roof gutter 12, similar to a conventional downspout, but arranged such that clogging from debris is minimized. Apparatus 10 has a substantially vertical wall 14 located at one end of gutter 12. Substantially vertical wall 14 has an opening 16 therein which provides fluid communication to a conduit 18. Conduit 18 has a substantially horizontal portion 20 extending from vertical wall 14 to a transition section 22 which gradually turns approximately 90° to a substantially vertical portion 24.

Vertical wall 14 is preferably located at a lower end of gutter 12 so that water will flow toward opening 16 via gravity. Opening 16 is located as close to a bottom surface 26 of gutter 12 as possible so that no water will stand in gutter 12 unable to flow out. Such standing water is a breeding place for insects and is therefore undesirable.

Conduit 18 has a closed shape which may be rectangular or round or have any other cross-section having substantially smooth inner walls. Transition section 22 preferably has an inside turning radius of at least one inch so that the conversion from substantially horizontal flow through conduit 18 to substantially vertical flow is as gradual as possible. A gradual transition minimizes rainwater turbulence and is less likely to become clogged with longer pieces of debris.

Opening 16 preferably has a size of at least four square inches. Larger openings are preferable in order to adequately drain the gutter in the presence of floating debris. The smaller the opening, the more likely plugging will occur. It is also preferable that conduit 18 have the same cross-section throughout as opening 16 so that there are no choke points within the conduit to trap debris and cause plugging. An upper limit on the size of opening 16 and conduit 18 is determined by the size of the substantially vertical wall at the end of the gutter and by the appearance of the conduit, which is generally designed to extend beyond the edge of the roof. A preferred conduit is made of 3 inch schedule 40 PVC pipe, with a 90° elbow as the transition section.

Connecting a round conduit to a metal gutter end plate can be accomplished with the gutter in place. First a round hole is created in the endplate about an inch in diameter smaller than the outer diameter of the conduit. This can be accomplished by means of a chassis punch or by drilling a series of adjacent holes in a circular pattern and then snipping the metal between holes with metal shears. Once the round hole is generated, metal cutting shears can be used to cut evenly spaced radial slits outward from the hole to a diameter slightly larger than the conduit. The slits form side-by-side trapezoidal segments. Using pliers, each segment can be bent outward a little more than 90° one at a time to open the round hole to the size of the conduit. The conduit can then be placed into the opening with the segments folded back against the outside of the conduit. Finally, holes are drilled through the segments and into the conduit so that self-tapping screws can connect the segments to the conduit to hold it in place. Caulking can then be placed between the rough round hole and the outside of the conduit for a leak-resistant connection. Screws should extend only slightly, if at all, into the inside of the conduit, so as to minimize catch-points for debris. The conduit should be supported from the building as well as from the gutter to minimize stress placed on the gutter.

Conduit 18 carries both rainwater and debris from gutter 12 to ground level. At ground level the conduit may feed a buried drain pipe or a diffuser, which directs the water and debris away from the building foundation. If the amount of debris is excessive, it may be better to avoid connecting the conduit to a buried drain pipe. The advantage of the diffuser is that debris ends up at the discharge of the above ground diffuser where it can easily be picked up for disposal.

In an alternative embodiment, not shown, a conduit is located at the upper end of a gutter instead of at the lower end. A conventional downspout is located at the lower end of the gutter. In this embodiment, rainwater flows to the conventional downspout until it becomes clogged. Then, as water rises in the gutter, it begins to flow to the conduit at the upper end of the gutter. This arrangement allows the conduit to provide overflow protection for the gutter as long as the bottom of the conduit opening in the end plate is at a level below the upper edge of the gutter's lower end.

Figure 2:
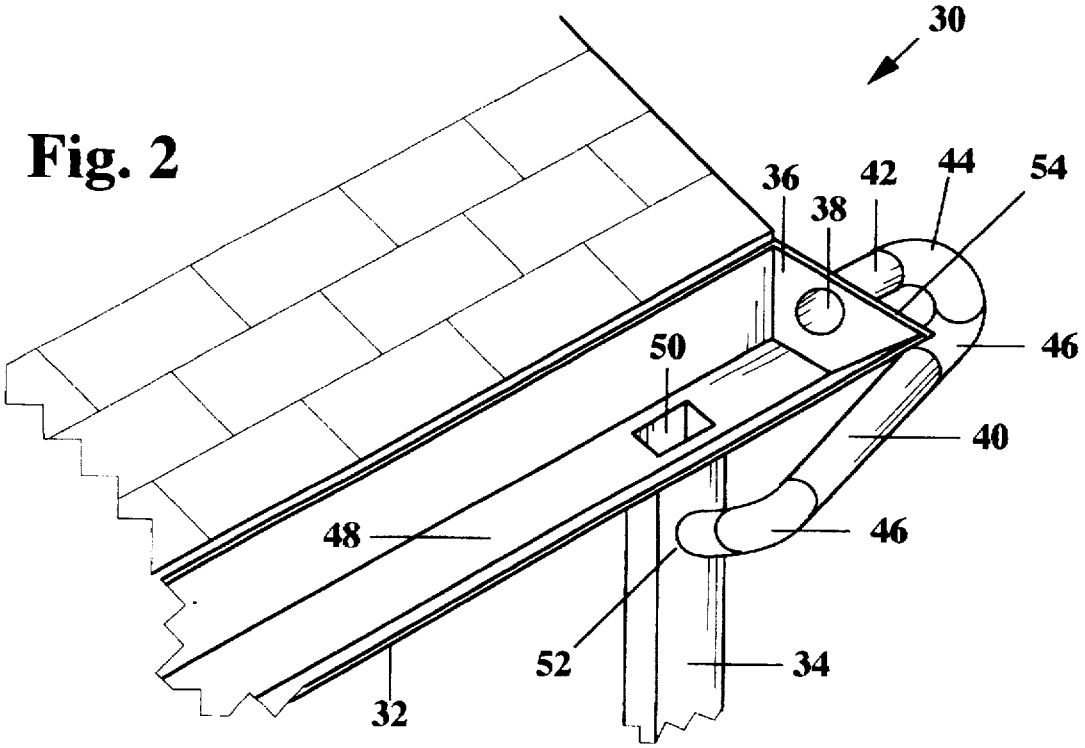
FIG. 2 is a perspective view thereof, disclosing a conduit connected to the vertical wall of the gutter at its upper end and to a conventional downspout at its lower end to serve as a bypass for the conventional downspout.

FIG. 2 discloses yet another embodiment of the present invention, generally indicated as 30. Embodiment 30 is an apparatus which provides overflow protection to a roof gutter 32 by providing a bypass for a clogged opening to a conventional downspout 34. Apparatus 30 has a substantially vertical wall 36 located at one end of gutter 32. Substantially vertical wall 36 has an opening 38 therein which provides fluid communication to a conduit 40.

Conduit 40 has a substantially horizontal portion 42 extending from vertical wall 36 to a transition section 44, which gradually turns approximately 90° downward. Instead of a vertical portion dropping to ground level, transition section 44 leads to further gradually turning sections 46, which direct conduit 40 toward downspout 34.

Downspout 34 is connected to a bottom surface 48 of gutter 32. Surface 48 has a downspout opening 50 which provides fluid communication from gutter 32 to downspout 34. Conduit 40 connects to downspout 34 at a connection point 52 below bottom surface 48 of gutter 32, where an opening (not shown) in downspout 34 provides fluid communication with conduit 40. Preferably, connection point 52 is located at least 6 inches below bottom surface 48 so that there is ample drop or water head in conduit 40 to ensure that debris is flushed through it and into downspout 34. If downspout 34 is connected to a buried drain pipe, and the amount of debris flushed from the gutter during a storm is high, it may be advisable to provide an opening in downspout 34 near ground level for screening out debris before it can plug the buried drain pipe. Such screening may be associated with a ground level diffuser to ensure that any escaping water is directed away from the building foundation.

Vertical wall 36 is preferably located at a lower end of gutter 32 so that water will flow toward opening 38 via gravity. Opening 38 is preferably located as close to an upper edge 54 of gutter 32 as possible so that floating debris may be lifted to where it may pass over edge 54 while rainwater flows beneath the debris into conduit 40. In this location, conduit 40 truly serves as a bypass in the event that opening 50 to downspout 34 becomes plugged and water rises within gutter 32. There is generally no concern for standing water in gutter 32 because downspout 34 will eventually drain such water even if opening 50 is mostly plugged.

Conduit 40 is preferably made of the same material and has the same cross-section as conduit 18 in the first embodiment of the present invention. In addition, conduit 32 may be connected to gutter 32 and downspout 34 in the same manner as described for the connection of conduit 18.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A method for providing rainwater overflow protection for a roof gutter, said method comprising the steps of:

a) removing rainwater from said gutter via a conduit connected to said gutter at a substantially vertical wall of said gutter, said substantially vertical wall having an opening therein providing fluid communication between said gutter and said conduit; and b) directing said rainwater from said opening in said gutter through said conduit such that a substantially horizontal rainwater flow direction is gradually converted to a downward flow direction within said conduit.

2. The method of claim 1 wherein said substantially vertical wall is located at a lower end of said gutter.

3. The method of claim 1 wherein said conduit has an inside turning radius of at least one inch between a substantially horizontal portion and a substantially vertical portion, said conduit also having an internal cross-sectional area of at least four square inches at said opening.

4. The method of claim 1 wherein said opening in said substantially vertical wall is located as close as possible to a bottom surface of said gutter.

5. The method of claim 1 wherein a portion of said rainwater is further directed via said conduit from said gutter to a conventional downspout, said downspout having fluid communication with a bottom surface of said gutter at an opening in said bottom surface, said conduit joining said conventional downspout at a location at least six inches below said bottom surface and in fluid communication with said conventional downspout, said conduit serving as a bypass for a conventional downspout opening when said downspout opening becomes clogged with debris.

6. The method of claim 5 wherein said opening in said substantially vertical wall is located less than an inch below a top edge of said gutter.

7. An apparatus providing rainwater overflow protection on a roof gutter, said apparatus comprising:

a) a conduit connected to said gutter at a substantially vertical wall of said gutter, said substantially vertical wall having an opening therein providing fluid communication between said gutter and said conduit; and b) a transition section in said conduit, said transition section gradually converting a substantially horizontal rainwater flow direction to a downward flow direction within said conduit.

8. The apparatus of claim 7 wherein said substantially vertical wall is located at a lower end of said gutter.

9. The apparatus of claim 7 wherein said transition section has an inside turning radius of at least one inch between a substantially horizontal portion and a substantially vertical portion, said conduit also having an internal cross-sectional area of at least four square inches at said opening.

10. The apparatus of claim 7 wherein said opening in said substantially vertical wall is located as close as possible to a bottom surface of said gutter.

11. The apparatus of claim 7 wherein a portion of said rainwater is further directed via said conduit from said gutter to a conventional downspout, said downspout having fluid communication with a bottom surface of said gutter at an opening in said bottom surface, said conduit joining said conventional downspout at a location at least six inches below said bottom surface and in fluid communication with said conventional downspout, said conduit serving as a bypass of a conventional downspout opening when said downspout opening becomes clogged with debris.

12. The apparatus of claim 7 wherein said opening in said substantially vertical wall is located less than an inch below a top edge of said gutter.

* * * * *